United States Patent [19]

Wakita

[11] 4,056,083

[45] Nov. 1, 1977

[54] EXHAUST GAS RECIRCULATOR FOR PURIFICATION OF EMISSION FROM AN INTERNAL COMBUSTION ENGINE

[75] Inventor: Nobuaki Wakita, Susono, Japan

[73] Assignee: Toyota Jidosha Kogyo Kabushiki Kaisha, Japan

[21] Appl. No.: 681,699

[22] Filed: Apr. 29, 1976

[30] Foreign Application Priority Data

Dec. 19, 1975 Japan ..... 50-172053[U]

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,800,764 | 4/1974 | Goto et al. | 123/119 A |
| 3,828,746 | 8/1974 | DeMartelaere | 123/119 A |
| 3,877,452 | 4/1975 | Nohira et al. | 123/119 A |
| 3,878,823 | 4/1975 | Vartanian | 123/119 A |
| B 480,384 | 3/1976 | Hashiguchi et al. | 123/119 A |
| Re. 27,993 | 4/1974 | Walker | 123/119 A |

*Primary Examiner*—Wendell E. Burns

*Attorney, Agent, or Firm*—Oblon, Fisher, Spivak, McClelland & Maier

[57] ABSTRACT

An exhaust gas recirculator for purification of emission from an internal combustion engine characterized in that an exhaust gas recirculation pipe links the intake manifold and the exhaust pipe connected to the engine cylinder, midway in which is inserted a recirculation control valve acting by the negative pressure of the intake manifold. An orifice with its sectional area variable in the displacement direction of the valve body is provided in the chamber of the recirculation control valve, and a desired flow characteristic of the exhaust gas is obtained by the setting of the orifice configuration.

4 Claims, 9 Drawing Figures

EXHAUST GAS RECIRCULATOR FOR PURIFICATION OF EMISSION FROM AN INTERNAL COMBUSTION ENGINE

BACKGROUND OF THE INVENTION

1. Field of the Invention

The present invention relates generally to an emission purifier of an internal combustion engine in which the exhaust gas thereof is purified by recirculating a part of the gas to the cylinder to be reburned, and more specifically to a device for improving the flow characteristics of a recirculated exhaust gas.

2. Description of the Prior Art

A device for purifying the emission from an internal combustion engine by recirculating a part of the exhaust gas back to the cylinder has been widely used. In the conventional device, however, the valve-opening characteristic is fixed and, accordingly, it is unavoidable that, when mounted on a vehicle, it recirculates, under a light load, a great volume of exhaust gas to the cylinder, thereby drastically deteriorating the running performance, while, under heavy load, the volume of the recirculated gas cannot be increased infinitely.

SUMMARY OF THE INVENTION

Accordingly, a primary object of the present invention is to provide a device which affords an improved flow characteristic for the recirculated exhaust gas.

Another object of the present invention is to provide a device for purifying the emission from an internal combustion engine by recirculating part of the exhaust gas back to the cylinder, in which under light load, the gas recirculation is decreased and, under heavy load, it is increased.

Still another object of the present invention is to provide a device for purifying the emission from an internal combustion engine by recirculating part of the exhaust gas back to the cylinder, in which the secondary air for the post-treatment of the exhaust gas maybe suitably controlled.

The foregoing and other objects are attained according to the present invention through the provision of an exhaust gas recirculator having an exhaust gas recirculation pipe which links the intake manifold and the exhaust pipe being connected to the engine cylinder, a recirculation control valve disposed midway in the exhaust gas recirculation pipe and being operative by the negative pressure of the intake manifold, an orifice opening into a valve chamber of the recirculation control valve having a variable sectional area opening in the displacement direction of the valve body, which is controlled by the negative pressure of the intake manifold, and the valve body being configured substantially as a truncated cone, around which a plurality of orifices are arranged in combination, whereby the flow rate of the exhaust gas recirculated to the intake manifold can be continuously controlled by the displacement of the valve body caused by the negative pressure of the intake manifold.

BRIEF DESCRIPTION OF THE DRAWINGS

Other objects, features and attendant advantages of the present invention will be more fully appreciated as the same becomes better understood from the following detailed description when considered in connection with the accompanying drawings, in which like reference numerals designate like or corresponding parts throughout the several views, and wherein.

DETAILED DESCRIPTION OF THE ILLUSTRATED EMBODIMENTS

Before proceeding to the description of the illustrated embodiments according to the present invention, the conventional device for purifying the emission from the internal combustion engine by recirculating a part of the exhaust gas to the cylinder is to be described.

Figure 1:
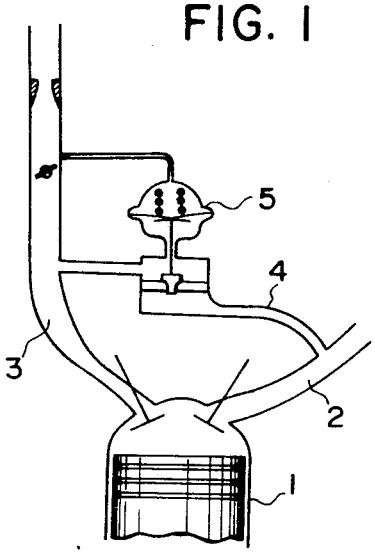
FIG. 1 is a schematic view illustrating a conventional exhaust gas recirculator.
Figure 2:
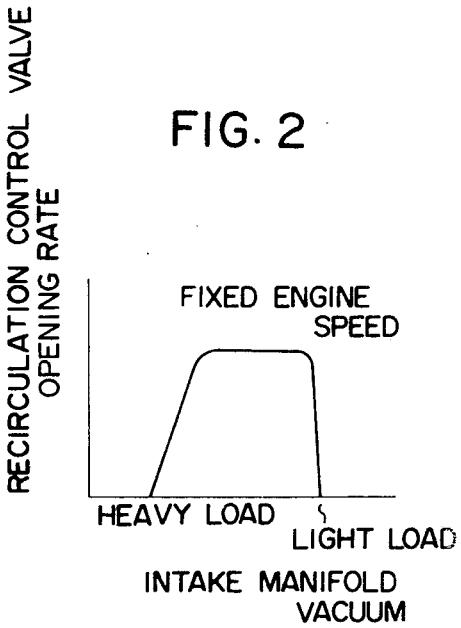
FIG. 2 is a diagram showing the valve-opening characteristics of the conventional device shown in FIG. 1.
Figure 3:
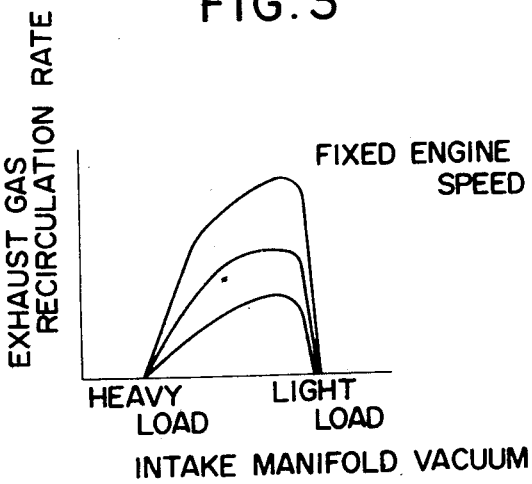
FIG. 3 is a diagram showing the gas recirculation rate in the conventional device of FIG. 1.

FIG. 1 shows an example of such a device in which an exhaust gas recirculation pipe 4 links an exhaust pipe 2 and the intake manifold 3, connected to the engine cylinder 1, and a recirculation control valve 5 is provided in the recirculation pipe 4, acting by the negative pressure working in the intake manifold 3. Depending on the negative pressure in the intake manifold 3, the recirculation control valve 5 opens or closes to recirculate a part of the exhaust gas, which has flowed into the exhaust pipe 2, to the intake manifold 3. The device of this type possesses such a valve-opening characteristic as illustrated in FIG. 2 and, accordingly, the gas recirculation rate turns out as illustrated in FIG. 3.

Thus, when mounted on a vehicle, such a device unavoidably sends, under light load, an excessive volume of recirculated gas to the cylinder and, under heavy load, it cannot infinitely increase the volume of recirculated gas.

Figure 4:
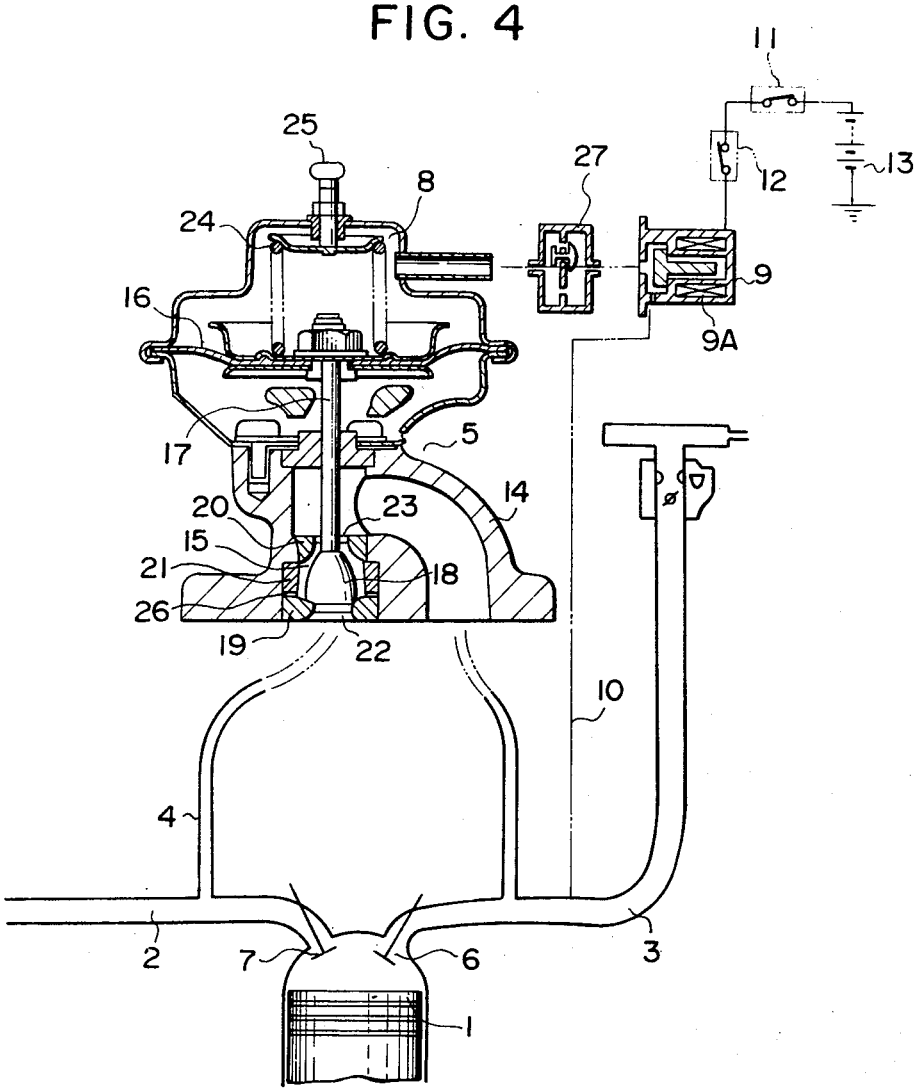
FIG. 4 is a longitudinal sectional view of one embodiment of the present invention.

An embodiment of the present invention is illustrated in FIG. 4, in which, just as in FIG. 1, an exhaust gas recirculation pipe 4 links the exhaust pipe 2, connected to the cylinder 1 through exhaust valve 7, and the intake manifold 3, connected to the engine cylinder 1, through an intake valve 6, and a recirculation control valve 5 is inserted midway in the pipe 4. A diaphragm chamber 8 in the recirculation control valve 5 and the intake manifold 3 are connected via a negative pressure signal switch valve 9 and a negative pressure introducing pipe 10. Meanwhile, an energizing coil 9A for the negative pressure signal switch valve 9 is connected to a power supply 13 through an engine rpm detecting switch 11 and a water temperature switch 12 for detecting the water temperature of the intake manifold. Also within a housing 14 of the recirculation control valve 5 is a valve chamber 15 communicating with the diaphragm chamber 8 and the exhaust gas recirculation pipe 4. This valve chamber 15 holds a vertically movable valve body 18, which is supported via a valve stem 17 on a diaphragm 16 in the diaphragm chamber 8. Within the valve chamber 15, a first orifice defining portion 19, a second orifice defining portion 20 and a third orifice defining portion 21 open around the valve body 18.

In the illustrated example, the valve body 18 is approximately a truncated cone with the first orifice 19 being located at the bottom thereof, the second orifice 20 being located opposite to the head of the body 18 and the third orifice 21 being located between the first orifice 19 and the second orifice 20. The first orifice defining portion 19 has a valve opening 22 to be closed by the bottom of the valve body 18 and a flat seat to receive the bottom of the body 18. In the second orifice defining portion 20, a valve opening 23 of small diameter opens, corresponding to the small-diameter head of the valve body 18, and a splayed hole of a shape approximately corresponding to the contour of the valve body 18 originates from the valve opening 23. The third orifice defining portion 21 has an inside surface of a slope slightly reduced in steepness toward the top, i.e., of the shape corresponding to the contour of the valve body 18.

In FIG. 4, a spring 24 is set within a diaphragm chamber 8, with an adjust screw 25 being provided therefor. A negative pressure signal delay valve 27 is provided in the path of the negative pressure introducing pipe 10, between the diaphragm chamber 8 and the negative pressure signal switch valve 9.

Figure 5:
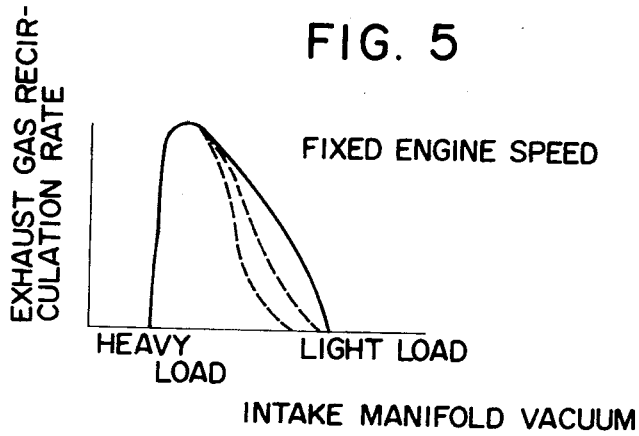
FIGS. 5 and 6 are diagrams illustrating the gas recirculation rate in the present invention.
Figure 6:
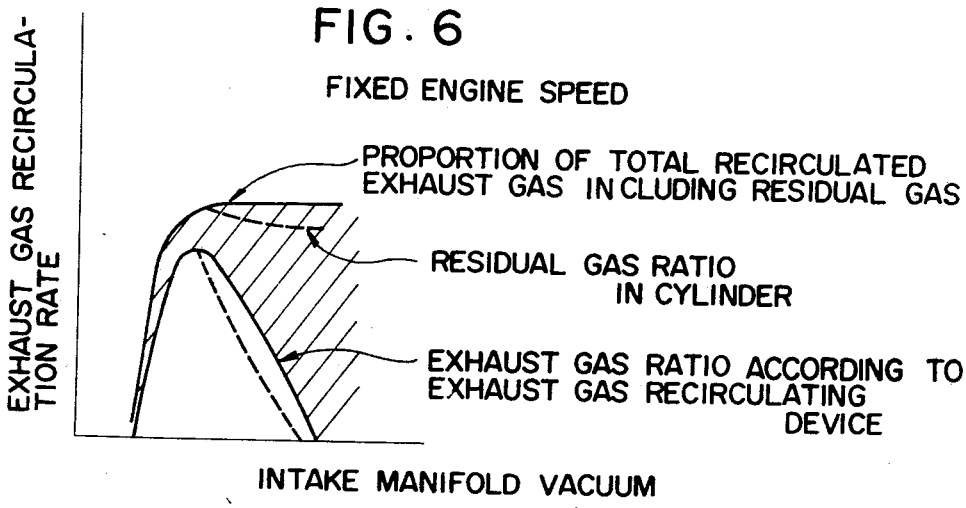
Figure 7:
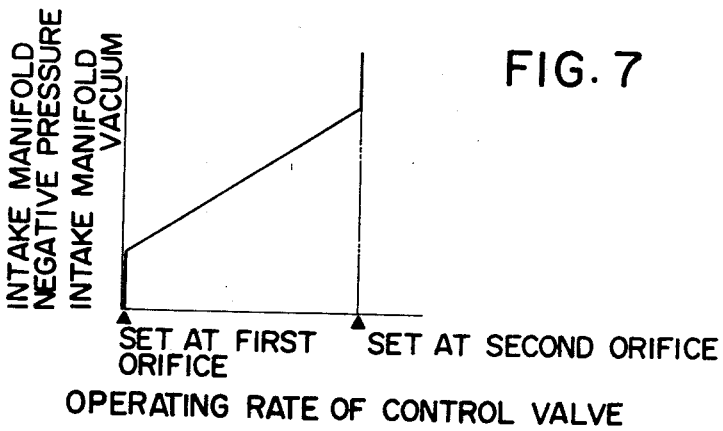
FIG. 7 shows a lift characteristic of the recirculation control valve in the present invention.

In the illustrated embodiment, the gas mixture introduced into the intake manifold 3 reaches the cylinder 1 and goes out via the exhaust pipe 2. A part of this exhaust gas goes from the exhaust pipe 2, via the exhaust gas recirculation pipe 4, to the recirculation control valve 5. When the negative pressure signal switch valve 9 is open, the recirculation control valve 5 acts under the negative pressure in the intake manifold 3 to open the valve opening 22 in the valve body 18, whereupon the exhaust gas passes through the gap between the orifice defining portions 19 - 21 and, with its flow rate controlled depending on the position of the valve body 18, the exhaust gas flows back into the intake manifold 3. Thus, corresponding to the negative pressure of the intake manifold, the flow of the gas being recirculated to the intake manifold can be continuously controlled. The spring pressure working on the diaphragm 16 is adjustably set by the adjust screw 25, thereby controlling the shut pressure of the opening 23 in the second orifice defining portion 20 and the thickness of an adjust washer 26 inserted between the first orifice defining portion 19 and the third orifice portion 21 is adjusted, thereby controlling the shut pressure of the opening 22 in the first orifice defining portion 19. The negative pressure of the intake manifold 3 and the reaction to the spring 24 working on the diaphragm decide the lift characteristics of the valve body 18, as shown in FIG. 7, and the configurations set for each orifice and the valve body decide the flow characteristics of the recirculated gas, as indicated in FIG. 5. In accordance with these characteristics, the gas recirculation can be decreased under light load and increased under heavy load. Thus, the proportion of the total exhaust gas, including the residual gas in the cylinder, can be kept constant, as illustrated in FIG. 6. In this example, supply of negative pressure to the diaphragm chamber 8 of the recirculation control valve 5 is controlled by the negative signal switch valve 9. When at engine start, or at low running of engine, such as, for example, around 1000 rpm, the rpm detect switch 11 of the engine is open, or when the water temperature switch is open with the water temperature in the intake manifold riser standing at less than 50° C, the energizating coil 9A of the negative signal switch valve 9 is cut off from the power supply 13, and,with the negative signal switch valve 9 closed, the negative pressure signal of the intake manifold is not being given to the diaphragm chamber 8. Therefore, in this state, the recirculated gas is not supplied to the intake manifold 3. Gas recirculation takes place only when the water temperature exceeds a certain value or when the engine rpm exceeds a certain limit.

In the transient state, when the throttle valve is gradually opened by the action of the negative pressure signal delay valve 27, the recirculated gas begins to flow into the intake manifold with delay, and as the throttle is increasingly opened, the flow rate of recirculated gas steadily increases. When the throttle valve is full-open, the gas recirculation ceases with a certain time delay. When a full-open throttle valve is gradually closed, gas recirculation resumes fast, without delay, and the gas begins to flow into the intake manifold 3, the flow rate decreasing as the throttle valve is increasingly closed. It can be so arranged that the flow of gas into the intake manifold can be swiftly stopped, without delay, as the throttle is closed until the negative pressure of the suction pipe drops below the set value.

As described above, the present invention makes it possible by a simple system to recirculate a large volume of exhaust gas under heavy load, which has been heretofore deemed to be extremely difficult. According to the present invention, not only can the flow characteristics of the recirculated gas, as indicated by the solid line in FIG. 6, be increased, but also recirculation of a large volume of exhaust gas, under heavy load, can be realized through the combination of the orifices 19, 20, 21 and, even the flow characteristics, as indicated by the broken line in FIG. 6, can be improved. In the illustrated example, it is arranged such that the valve openings provided in the first orifice defining portion 19 and the second orifice defining portion 20 can be respectively opened or closed. In the conventional arrangement with a single orifice provided for flow rate control, it is impossible to freely select the valve-opening and the valve-closing characteristics, and thus, if a fast rise characteristic under heavy load is set, unavoidably the rise characteristic under light load becomes equally fast. According to the present invention, the valve-opening and the valve-closing characteristics can be freely selected, and the flow characteristic can be set such that the proportion of the total recirculated exhaust gas in the cylinder, including the residual gas, becomes constant, as indicated in FIG. 6.

In the illustrated example, the configuration of the orifices formed in the valve chamber is selected conforming to the valve body of the recirculation control valve 5. It is also possible to control the flow rate of recirculated gas passing through the gap by modifying the configuration of the valve body conforming to the set configuration of the orifices provided in the valve chamber. Further, it is possible to provide more than two diaphragms in the diaphragm chamber 8 of the recirculation control valve 5 and control the displacement of the valve body by the negative pressure of suction in the intake manifold inserted therein.

Figure 8:
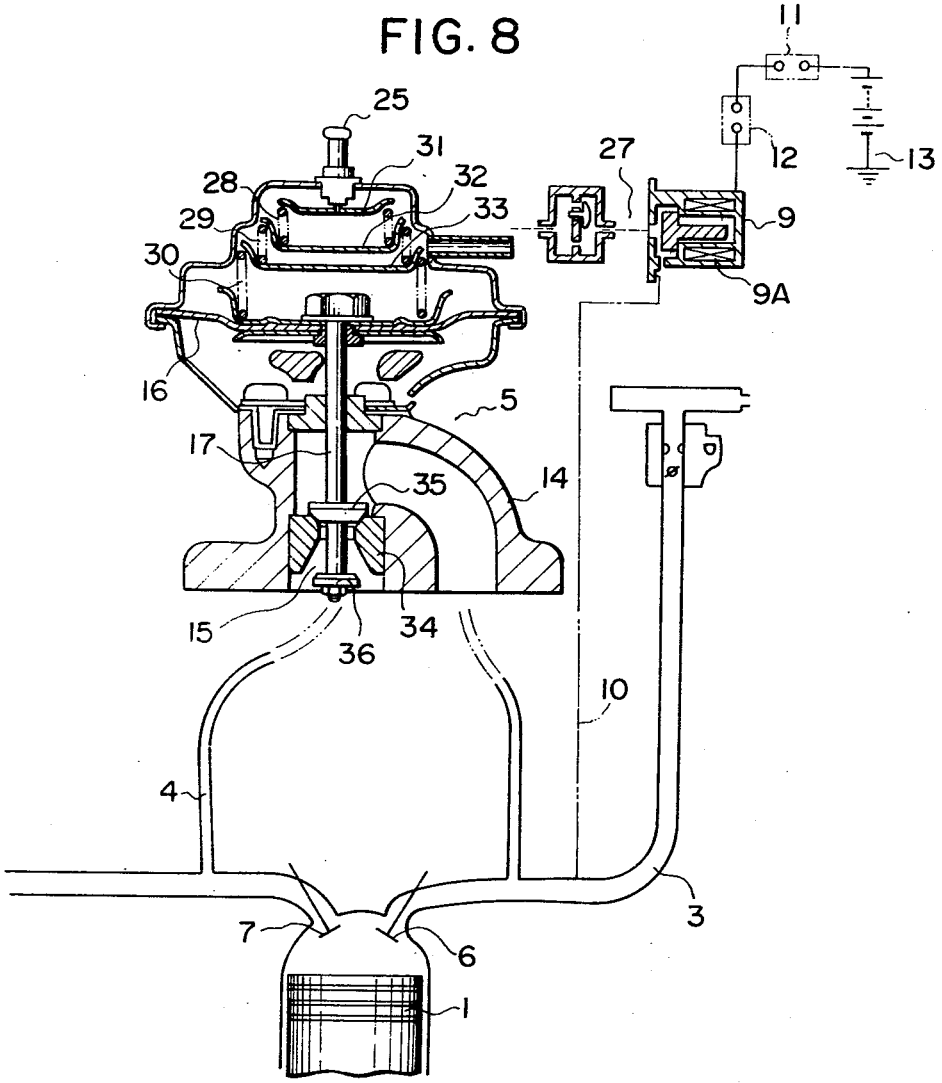
FIG. 8 is a longitudinal sectional view illustrating another embodiment of the present invention.
Figure 9:
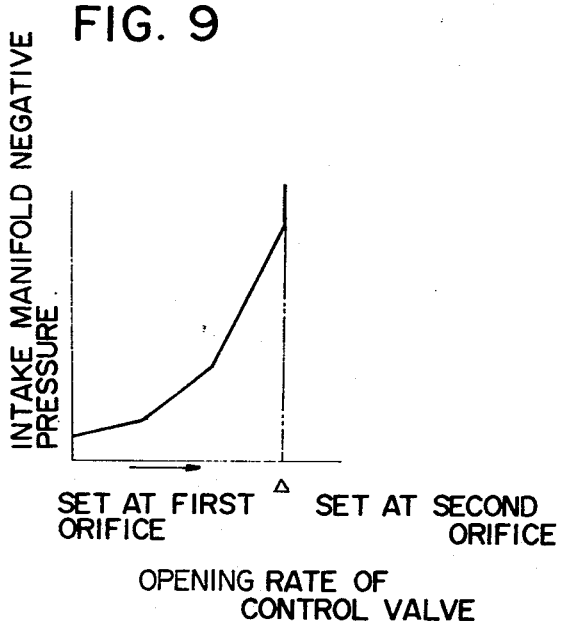
FIG. 9 shows the lift characteristics in the embodiment illustrated in FIG. 8.

In FIG. 8 illustrating a variation of the embodiment described herein, several springs 28, 29 and 30 hold down the diaphragm 16 in the diaphragm chamber 8, being arranged with hold-down plates 31, 32 and 33, respectively, and in this case, the lift characteristic of the whole recirculated exhaust gas becomes as shown in FIG. 9. In this way, it is easy to design such so that the flow characteristic of recirculated exhaust gas can meet the requirement. Meanwhile, it will also be possible to combine an orifice 34 having a neck at midpart and a splay above and below the neck with a pair of valve bodies 35 and 36 provided matching the upper and lower parts of the orifice 34, and, in this case too, it will be easy to secure the desired flow characteristic of the recirculated exhaust gas.

Obviously, many modifications and variations of the present invention are possible in light of these teachings. It is therefore to be understood that within the scope of the appended claims, the present invention may be practiced otherwise than as specifically described herein.

What is claimed as new and desired to be secured by Letters Patent of the United States is:

1. An exhaust gas recirculator for purification of emission from an internal combustion engine, comprising:

a cylinder;

an intake manifold connected to said cylinder;

an exhaust pipe;

an exhaust gas recirculation pipe connected between said intake manifold and said exhaust pipe;

a recirculation control valve inserted midway in said exhaust gas recirculation pipe, which has a diaphragm, a diaphragm chamber provided at one side of said diaphragm and connecting to said intake manifold, a valve body configured substantially as a truncated cone and connected to said diaphragm, and a plurality of springs provided in series in said diaphragm chamber and working such reaction force on said diaphragm as varies phasedly in accordance with the displacement of said valve body; and a plurality of orifices opened in the valve chamber of said recirculation control valve, and arranged in combination around said valve body, said orifices being constituted such that they can change the flow area in the valve-opening direction of the valve body, which is controlled by the negative pressure of said intake manifold, whereby the flow rate of exhaust gas recirculated to the intake manifold can be continuously controlled by the displacement of the valve body caused by the negative pressure of the intake manifold.

2. A device as set forth in claim 1, wherein said plurality of orifices are three in number, being arranged around the valve body of said recirculation control valve, the first orifice being located at the bottom of said valve body, the second orifice being located opposite to the head of said valve body and the third orifice opening between the first and the second ones;

the first orifice providing a valve opening which can be closed by the bottom of said valve body and a flat seat to receive the bottom of said valve body;

the second orifice providing a small-diameter valve opening matching the small-diameter head of said valve body and a splayed hole corresponding approximately to the contour of said valve body; and the third orifice having an inside surface of a slope slightly reduced in steepness toward the top following the contour of said valve body.

3. A device as set forth in claim 2, wherein a washer is inserted between the first and third orifices and the shut pressure of the first orifice can be adjusted by controlling the thickness of said washer.

4. A device as set forth in claim 1, wherein said plurality of orifices provides an opening splayed in the vertical direction and combined with said orifices are a pair of bodies matching the top and bottom parts of said opening in said orifices.

* * * * *